US010522890B2

(12) United States Patent
Kang et al.

(10) Patent No.: US 10,522,890 B2
(45) Date of Patent: Dec. 31, 2019

(54) WAVEGUIDE FILTER INCLUDING COUPLING WINDOW FOR GENERATING NEGATIVE COUPLING

(71) Applicant: Samsung Electronics Co., Ltd., Gyeonggi-do (KR)

(72) Inventors: Haiju Kang, Guangdong (CN); lei Cai, Guangdong (CN)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/760,932

(22) PCT Filed: Sep. 9, 2016

(86) PCT No.: PCT/KR2016/010189

§ 371 (c)(1),
(2) Date: Mar. 16, 2018

(87) PCT Pub. No.: WO2017/047999

PCT Pub. Date: Mar. 23, 2017

(65) Prior Publication Data

US 2018/0269555 A1 Sep. 20, 2018

(30) Foreign Application Priority Data

Sep. 17, 2015 (CN) ..... 2015 1 0592105

(51) Int. Cl.
*H01P 1/208* (2006.01)
*H01P 7/10* (2006.01)
*H01P 1/20* (2006.01)

(52) U.S. Cl.
CPC ..... *H01P 1/2084* (2013.01); *H01P 1/2002* (2013.01); *H01P 1/2082* (2013.01); *H01P 7/10* (2013.01)

(58) Field of Classification Search
CPC .... H01P 1/2082; H01P 1/2084; H01P 1/2088; H01P 1/2002; H01P 7/10
(Continued)

(56) References Cited

U.S. PATENT DOCUMENTS 4,652,844 A 3/1987 Brambilla
9,666,921 B2 5/2017 Rogozine et al.
(Continued)

FOREIGN PATENT DOCUMENTS

CN 103618122 3/2014
CN 103797639 5/2014
(Continued)

OTHER PUBLICATIONS

International Search Report dated Nov. 25, 2016 issued in counterpart application No. PCT/KR2016/010189, 14 pages.
(Continued)

*Primary Examiner* — Rakesh B Patel
(74) *Attorney, Agent, or Firm* — The Farrell Law Firm, P.C.

(57) ABSTRACT

A waveguide filter including a coupling window for generating negative coupling includes: a plurality of resonators including a substrate block; and the coupling window provided between the plurality of resonators for coupling, wherein a length of a dimension element of the coupling window is equal to or greater than half a working wavelength of the waveguide filter. The waveguide filter may reverse a coupling polarity between resonators to generate negative coupling.

15 Claims, 11 Drawing Sheets

(58) Field of Classification Search
USPC ..... 333/208–210, 212
See application file for complete search history.

(56) References Cited

U.S. PATENT DOCUMENTS

| | | | | |
|---|---|---|---|---|
| 2001/0025013 | A1 | 9/2001 | Abdelmonem | |
| 2008/0122559 | A1 | 5/2008 | Hoft | |
| 2011/0241795 | A1* | 10/2011 | Kai | H01P 1/207 333/135 |
| 2012/0049983 | A1* | 3/2012 | Uhm | H01P 1/2086 333/212 |
| 2015/0077196 | A1* | 3/2015 | Yatabe | H01P 1/2002 333/135 |
| 2015/0077198 | A1 | 3/2015 | Yatabe | |
| 2015/0180103 | A1* | 6/2015 | Hendry | H01P 1/2086 333/212 |

FOREIGN PATENT DOCUMENTS

| | | |
|---|---|---|
| EP | 0 329 090 | 8/1989 |
| EP | 2 432 070 | 3/2012 |
| JP | 2003-158401 | 5/2003 |
| JP | 2008-543192 | 11/2008 |
| JP | 2015-050492 | 3/2015 |
| JP | 2015-056813 | 3/2015 |
| KR | 20-2009-0009633 | 9/2009 |
| KR | 1020130134692 | 12/2013 |

OTHER PUBLICATIONS

European Search Report dated Jun. 25, 2018 issued in counterpart application No. 16846820.5-1205, 9 pages.

* cited by examiner

WAVEGUIDE FILTER INCLUDING COUPLING WINDOW FOR GENERATING NEGATIVE COUPLING

PRIORITY

This application is a National Phase Entry of PCT International Application No. PCT/KR2016/010189, which was filed on Sep. 9, 2016, and claims priority to Chinese Patent Application No. 201510592105.5, which was filed on Sep. 17, 2015, the contents of each of which are incorporated herein by reference.

TECHNICAL FIELD

The present disclosure relates to a waveguide filter including a coupling window for generating negative coupling.

BACKGROUND ART

With the development of a filter industry, there has been a gradual trend toward smaller and lighter filters. Waveguide filters may substantially reduce a product size and have advantages of a high Q value and a low temperature-drift, and thus have become a good solution for the miniaturization of filters. Conventional waveguide filters and cavity filters still have certain technical problems such as a complicated structure with respect to cross coupling (negative coupling), and low structural flexibility, thus making filter operation difficult. For example, a current waveguide filter generating cross coupling has the following three patterns:

A first solution is a metal probe structure which may generate negative cross coupling. In order to actually implement the waveguide filter according to the first solution, a substrate is required to be punched and then a probe is inserted into the substrate. This solution has a difficulty with respect to assembling and fixation of the filter even though the waveguide filter may generate negative cross coupling. A second solution is a structure with external microband lines which may generate negative cross coupling. In order to actually implement the waveguide filter according to the second solution, firstly it is required that a surface of a substrate block is brushed with silver to form microband lines. Secondly, a probe is mounted which is connected to the substrate block. However, the waveguide filter according to the second solution increases the number of components of a product such that assembly and fixation are both cumbersome and of low efficiency. Also, the intensity of cross coupling generated by the waveguide filter according to the second solution is too weak to be amplified. A third solution is a metal probe structure used in a coaxial cavity filter for generating negative cross coupling. The waveguide filter according to the third solution needs a separate substrate for supporting the metal probe, and assembly is also complicated.

In this regard, development of a waveguide filter for generating negative coupling is required.

DETAILED DESCRIPTION OF THE INVENTION

Technical Problem

The present disclosure provides a waveguide filter including a coupling window for generating negative coupling.

Technical Solution

An embodiment provides a waveguide filter including: a plurality of resonators including a substrate block and a conductive layer covering a surface of the substrate block; and a coupling window provided on a contact surface between the plurality of resonators, the coupling window exposing the substrate block for coupling of the plurality of resonators, wherein a total window length of the coupling window is equal to or greater than half a working wavelength of the waveguide filter.

Advantageous Effects of the Invention

A waveguide filter according to the present disclosure may generate negative coupling by reversing coupling polarity between resonators since the total window length of coupling windows is equal to or greater than half a working wavelength of the waveguide filter.

The waveguide filter according to the present disclosure may have a flexible topology structure to form waveguide filters of various orders.

The waveguide filter according to the present disclosure may have a simple structure and may be suitable to processes.

The waveguide filter according to the present disclosure may also be covered with a conductive layer to facilitate connection and may be fixed by welding.

BEST MODE

Figure 1:
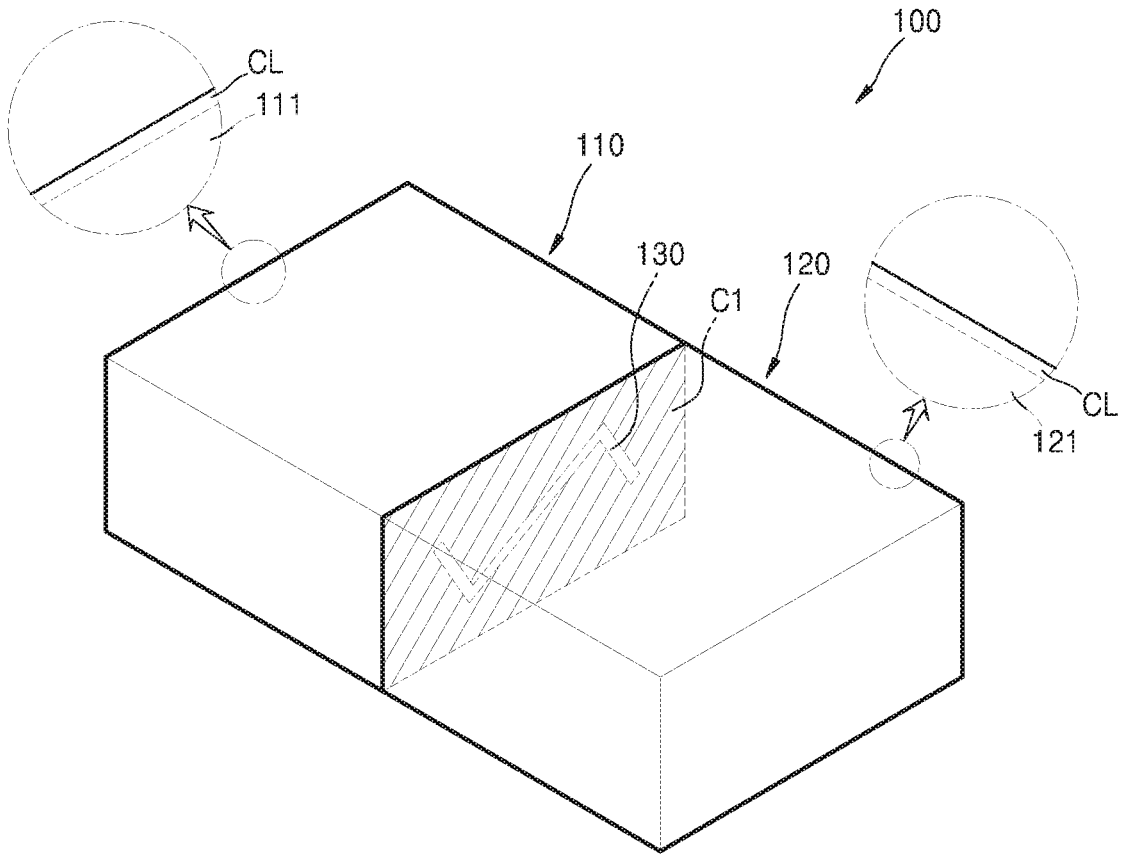
FIG. 1 is a perspective view schematically showing a structure of a waveguide filter according to an embodiment.

An embodiment provides a waveguide filter including: a plurality of resonators including a substrate block and a conductive layer covering a surface of the substrate block; and a coupling window provided on a contact surface between the plurality of resonators, the coupling window exposing the substrate block for coupling of the plurality of resonators, wherein a total window length of the coupling window is equal to or greater than half a working wavelength of the waveguide filter.

The coupling window may include a plurality of windows having shapes elongated in one direction, and the plurality of windows may be connected to each other.

The plurality of resonators may include a first resonator and a second resonator, and the coupling window may be located between the first resonator and the second resonator.

The coupling window may include a first window elongated in a first direction and a second window elongated in a second direction, and one end of the first window and one end of the second window may be connected to each other.

The coupling window may include a first window elongated in a first direction and a second window elongated in a second direction, and one end of the first window and a central portion of the second window may be connected to each other.

The coupling window may further include a third window elongated in a third direction that is connected to another end of the second window, and the first direction and the third direction may be parallel to each other.

An acute angle formed between the first window and the second window may be between 0 and 90 degrees.

The coupling window may further include a third window elongated in one direction and a fourth window elongated in one direction, and one end of the third window may be connected to another end of the second window, and an end of the fourth window may be connected to another end of the third window.

The first window and the third window may be parallel to each other, and the second window and the fourth window may be parallel to each other.

The coupling window may include a plurality of first window members each having an elongated shape in a first direction and parallel to each other along a second direction perpendicular to the first direction, and a plurality of second window members each having the elongated shape in the second direction and parallel to the second direction, and the plurality of second window members may not be in contact with each other, and each of the plurality of second members may be combined with one end of two adjacent first window members.

The substrate block may be formed of a dielectric material.

The conductive layer may be formed of silver.

The plurality of resonators may further include at least one independent adjustable member.

The plurality of resonators may be welded to each other and fixed.

The waveguide filter may further include: an input terminal; and an output terminal, wherein the input terminal and the output terminal may be located in different ones of the plurality of resonators.

The coupling window may have any one of a V shape, a T shape, a U shape, a W shape, an N shape, a twisted shape, and an arch shape.

A plurality of resonators including a substrate block and a conductive layer covering a surface of the substrate block; and a coupling window provided on a contact surface between the plurality of resonators, the coupling window exposing the substrate block for coupling of the plurality of resonators, wherein the coupling window includes a plurality of windows having elongated shapes in one direction, and the plurality of windows may be connected to each other.

The coupling window may have any one of a V shape, a T shape, a U shape, a W shape, an N shape, a twisted shape, and an arch shape.

MODE OF THE INVENTION

Hereinafter, a waveguide filter including a coupling window for generating negative coupling according to embodiments of the present disclosure will be described in detail with reference to the accompanying drawings. The same reference numerals throughout the detailed description denote the same (or similar) elements.

Figure 2:
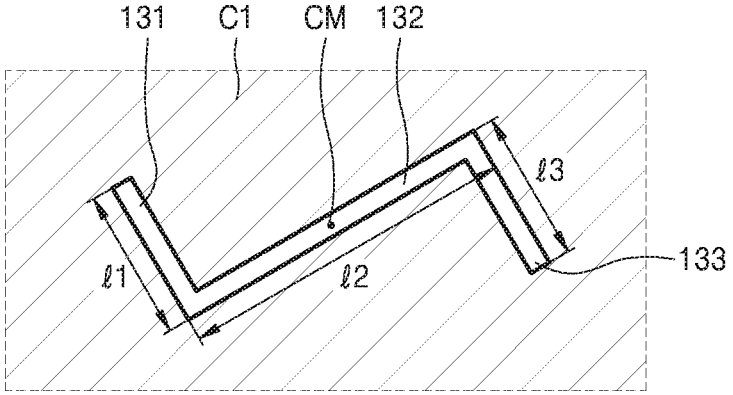
FIG. 2 is a cross-sectional view schematically showing a structure of a negative coupling window included in the waveguide filter according to FIG. 1.

FIG. 1 is a perspective view schematically showing a structure of a waveguide filter 100 according to an embodiment. FIG. 2 is a cross-sectional view schematically showing a structure of a negative coupling window 130 included in the waveguide filter 100 according to FIG. 1.

Referring to FIG. 1, the waveguide filter 100 includes a first resonator 110, a second resonator 120, and a coupling window 130 provided on a contact surface C1 between the first resonator 110 and the second resonator 120.

The first resonator 110 includes a first substrate block 111 covered with a conductive layer CL. The second resonator 120 includes a second substrate block 121 covered with a conductive layer CL.

The first substrate block 111 and the second substrate block 121 may be formed of a dielectric material. For example, the first substrate block 111 and the second substrate block 121 may be formed of a ceramic material. The first substrate block 111 and the second substrate block 121 may include two planar surfaces facing each other and side surfaces connecting the two planar surfaces. Referring to FIG. 1, the first substrate block 111 and the second substrate block 121 have a cubic shape, but are not limited thereto and may have various three-dimensional shapes. For example, the first substrate block 111 and the second substrate block 121 may have a shape of a cylinder, an elliptical column, a trapezoidal column, or the like.

The conductive layer CL may cover surfaces of the first substrate block 111 and the second substrate block 121 and may not cover the coupling window 130 on the contact surface C1. The conductive layer CL may be a layer formed of a conductive material and may include a metal material such as silver.

The coupling window 130 may be located in a region of the contact surface C1 between the first resonator 110 and the second resonator 120. The coupling window 130 may be a horizontal coupling window or a vertical coupling window. The coupling window 130 may be a region not covered by the conductive layer CL. The coupling window 130 may be a passage through which the first resonator 110 and the second resonator 120 are coupled to each other. For example, an energy mode of the first resonator 110 may be coupled to the adjacent second resonator 120 through the coupling window 130. Or an energy mode of the second resonator 120 may be coupled to the adjacent first resonator 110. Referring to FIGS. 1 and 2, the coupling window 130 is located in the center of the contact surface C1, but is not limited thereto and may be moved up, down, left, or right.

The coupling window 130 may include a plurality of windows 131, 132, and 133. Referring to FIG. 2, the plurality of windows 131, 132, and 133 may have an elongated structure in one direction. The plurality of windows 131, 132, and 133 may have a structure connected to each other. Referring to FIG. 2, ends of the plurality of windows 131, 132, and 133 are combined with each other, but are not limited thereto and may be combined in various forms. Various shapes of the coupling window 130 will be described later with reference to FIGS. 6 through 13.

A coupling pattern of the first resonator 110 and the second resonator 120 may be largely divided into positive coupling and negative coupling depending on a shape and size of the coupling window 130. The coupling window 130 may have a shape and length to generate negative coupling. The total window length (total of the coupling window 130 for negative coupling may be equal to or greater than half of a working wavelength λ of the waveguide filter 100. The total window length may be a sum of respective lengths 1*i*, 12, and 13 of the plurality of windows 131, 132, and 133. Therefore, in order to generate negative coupling between the first resonator 110 and the second resonator 120, the coupling window 130 may have to satisfy the following Equation 1.

$$l_{total} \geq \lambda/2 \quad \text{[Equation 1]}$$

The total window length $l_{total}$ of the coupling window 130 may be determined by measuring a length of each window with respect to a center of mass (CM). In this case, the above Equation 1 has to also be satisfied. The coupling window 130 satisfying Equation 1 may generate negative coupling of sufficient magnitude between the first resonator 110 and the second resonator 120.

Magnitude of negative coupling generated by the coupling window 130 may vary depending on the lengths $l_1$, $l_2$, and $l_3$ and widths of the plurality of windows 131, 132, and 133 constituting the coupling window 130, and may also vary depending on the shape of the coupling window 130. According to an experiment, the broader the widths of the plurality of windows 131, 132, and 133, the stronger the intensity of negative coupling formed between the resonators.

The first resonator 110 and the second resonator 120 may be bonded to each other and fixed. For example, the first resonator 110 and the second resonator 120 may be welded to each other, adhered with a conductive adhesive, fixed through a clamp fixture, or bonded through a sintering substrates integration process. The specific sintering process is as follows. Substrate powder is compressed at a high pressure of several tons or more. Then, sintering is done. Next, silver is brushed to form the coupling window 130 and sintered again.

Figure 3:
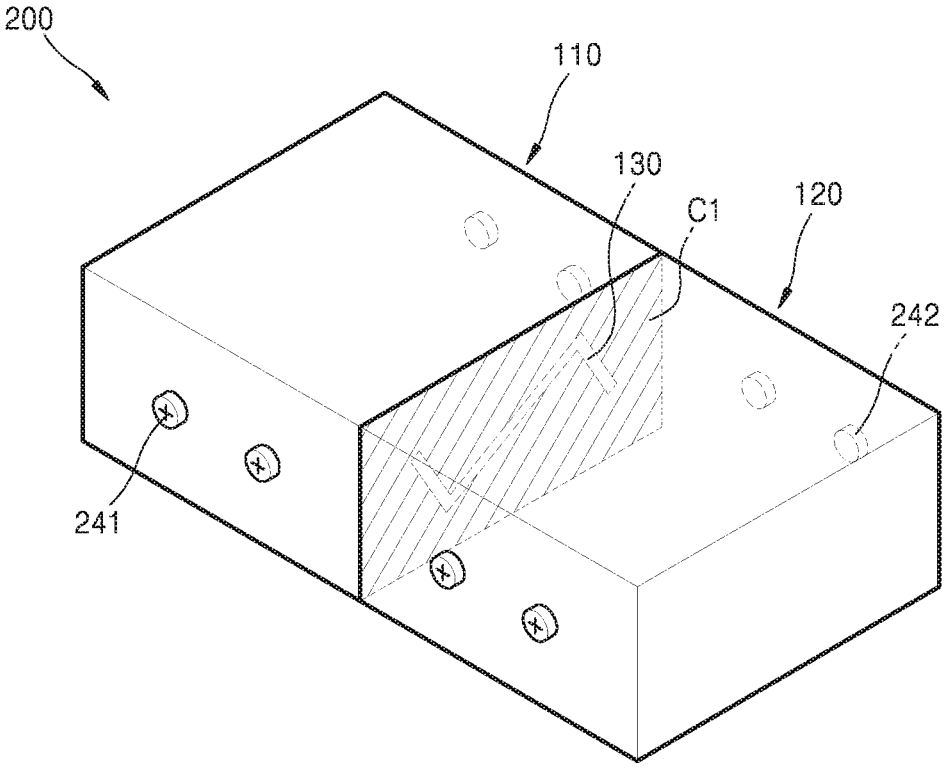
FIG. 3 is a perspective view schematically showing a structure of a waveguide filter according to another embodiment.
Figure 4:
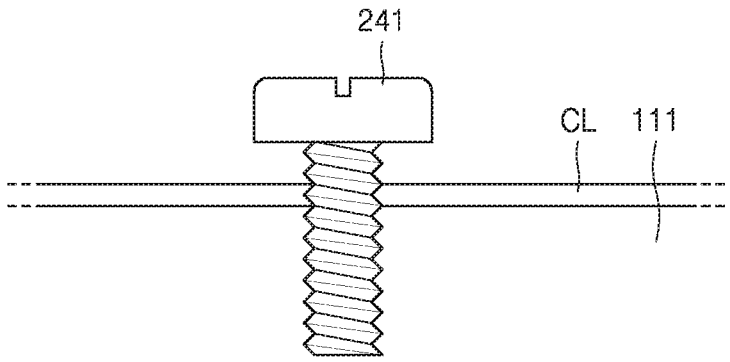
FIG. 4 is a cross-sectional view schematically showing a structure of an independent adjustable member included in the waveguide filter according to FIG. 3.

FIG. 3 is a perspective view schematically showing a structure of a waveguide filter 200 according to another embodiment. FIG. 4 is a cross-sectional view schematically showing a structure of an independent adjustable member 241 included in the waveguide filter 200 according to FIG. 3.

Referring to FIG. 3, the waveguide filter 200 may further include independent adjustable members 241 and 242. Other components of the waveguide filter 200 are substantially the same as those of the waveguide filter 100 of FIG. 1, and thus redundant descriptions thereof are omitted.

The at least one independent adjustable member 241 may be provided on the first resonator 110. The at least one independent adjustable member 242 may be provided on the second resonator 120. Since the independent adjustable member 241 and the independent adjustable member 242 are substantially the same components, only the independent adjustable member 241 will be described.

The independent adjustable member 241 may be provided on one surface of the first resonator 110. Referring to FIG. 4, the independent adjusting member 241 may be provided to penetrate the conductive layer CL of the first resonator 110. For example, the independent adjustable member 241 may come deeper or escape outward along a groove of the first resonator 110. Depending on a depth of the independent adjustable member 241, a frequency of an energy mode of the first resonator 110 may be adjusted. The at least one independent adjustable member 241 may be provided on at least one surface of the first resonator 110. For example, when the first resonator 110 has a cubic shape, the plurality of independent adjustable members 241 may be provided on two mutually adjacent surfaces of the cubic shape or on two opposing surfaces, respectively. For example, the plurality of independent adjustable members 241 may be provided on at least two or more planes perpendicular to each other.

For example, upon installation of the independent adjustable member 241, a hole of a type corresponding to the independent adjustable member 241 may be drilled in one surface of the first resonator 110. In case of the independent adjustable member 241 in a screw shape, the hole may also have a shape engaging with the screw shape.

The first resonator 110 includes the at least one independent adjustable member 241 and the second resonator 120 includes the at least one independent adjustable member 242 such that a resonance frequency of the energy mode may be easily changed through easy adjustment of the independent adjustable members 241 and 242. Also, an introduction of the independent adjustable members 241 and 242 may reduce a required degree of machining accuracy and thus reduce the cost and time required for the process.

Figure 5:
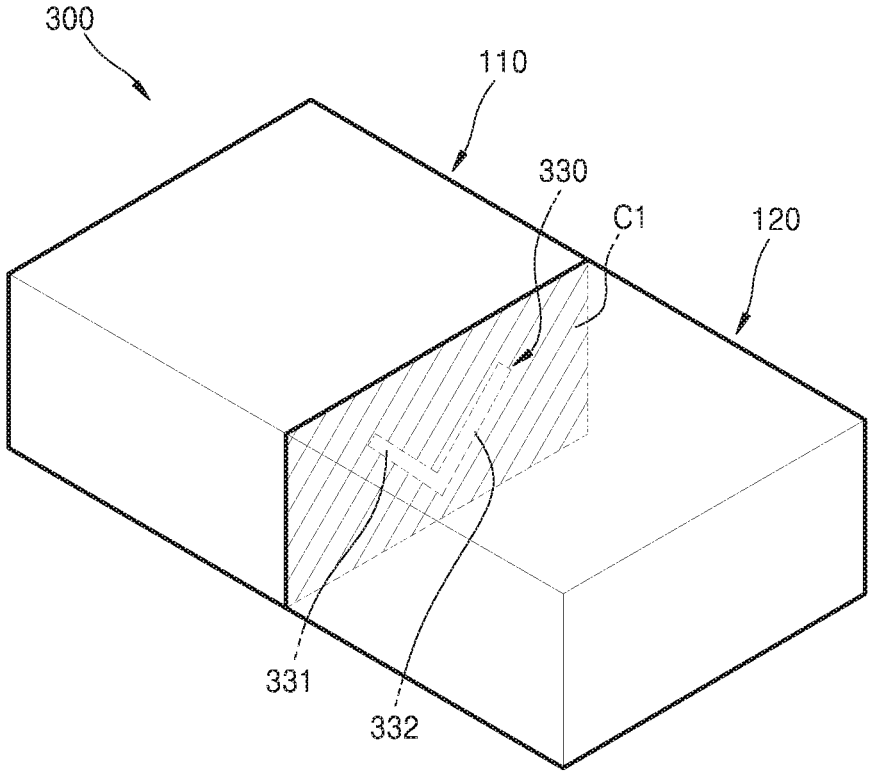
FIG. 5 is a perspective view schematically showing a structure of a waveguide filter according to another embodiment.

FIG. 5 is a perspective view schematically showing a structure of a waveguide filter 300 according to another embodiment. Referring to FIG. 5, the waveguide filter 300 may include a V-shaped coupling window 330. Other components of the waveguide filter 300 are the same as those of the waveguide filter 100, and thus detailed descriptions thereof will be omitted.

The coupling window 330 may include a first window 331 and a second window 332. The first window 331 and the second window 332 may have an elongated structure in one direction. The first window 331 and the second window 332 may have the same width and width, but are not limited thereto and may have various widths and widths. The total window length of the coupling window 330 may be equal to or greater than half a working wavelength of the waveguide filter 300. The coupling window 330 that satisfies these conditions may generate negative coupling.

One end of the first window 331 and one end of the second window 332 may be connected to each other. An angle formed by an extension line of the first window 331 in an elongated direction and an extension line of the second window 332 in the elongated direction may be previously determined. The angle formed by the first window 331 and the second window 332 may be between about 0 and about 90 degrees. For example, the coupling window 330 may be V-shaped when the angle formed by the first window 331 and the second window 332 is 15 degrees, 45 degrees, 60 degrees, and the like. For example, the coupling window 330 may be L-shaped when the angle formed by the first window 331 and the second window 332 is 90 degrees.

Figure 6:
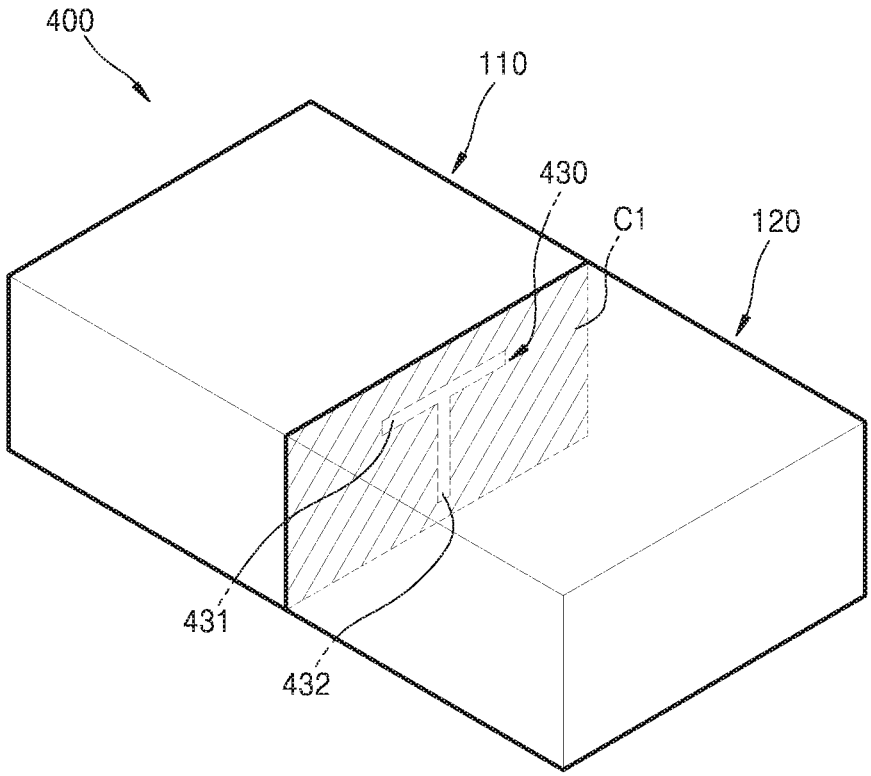
FIG. 6 is a perspective view schematically showing a structure of a waveguide filter according to another embodiment.

FIG. 6 is a perspective view schematically showing a structure of a waveguide filter 400 according to another embodiment. Referring to FIG. 6, the waveguide filter 400 may include a T-shaped coupling window 430. Other components of the waveguide filter 400 are the same as those of the waveguide filter 100, and thus detailed descriptions thereof will be omitted.

The coupling window 430 may include a first window 431 and a second window 432. The first window 431 and the second window 432 may have an elongated structure in one direction. The first window 431 and the second window 432 may have the same width and width but are not limited thereto and may have various widths and widths. The total window length of the coupling window 430 may be equal to or greater than half a working wavelength of the waveguide filter 400. The coupling window 430 that satisfies these conditions may generate negative coupling.

A middle end of the first window 431 and one end of the second window 432 may be connected to each other. An angle formed by an extension line of the first window 431 in an elongated direction and an extension line of the second window 432 in the elongated direction may be previously determined. The angle formed by the first window 431 and the second window 432 may be between about 0 and about 90 degrees. For example, the coupling window 430 may be T-shaped when the angle formed by the first window 431 and the second window 432 is 90 degrees.

Figure 7:
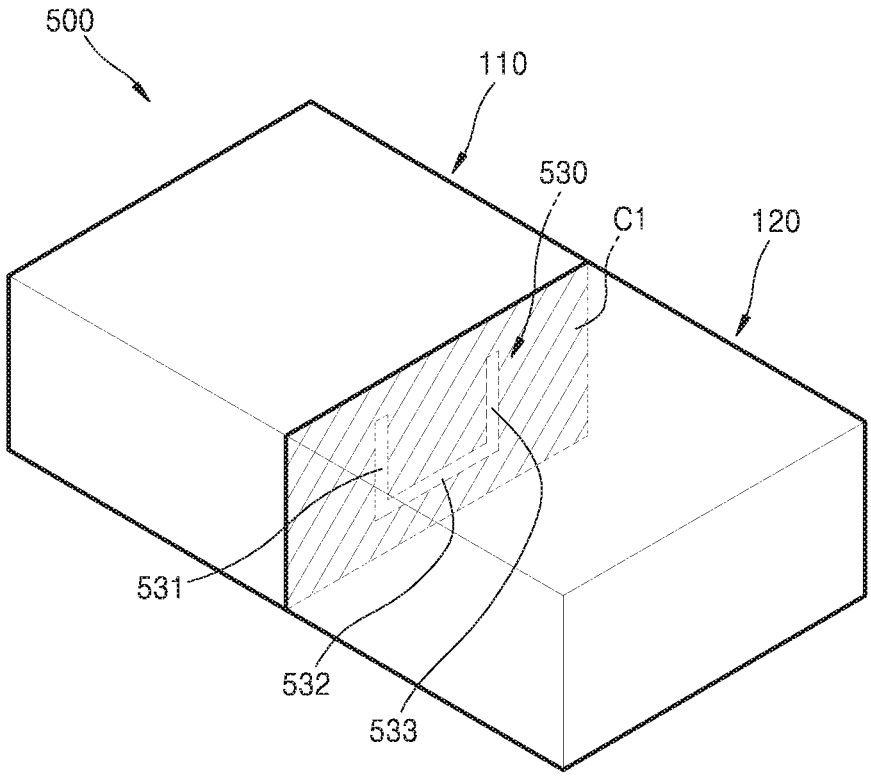
FIG. 7 is a perspective view schematically showing a structure of a waveguide filter according to another embodiment.

FIG. 7 is a perspective view schematically showing a structure of a waveguide filter 500 according to another embodiment. Referring to FIG. 7, the waveguide filter 500 may include a U-shaped coupling window 530. Other components of the waveguide filter 500 are the same as those of the waveguide filter 100, and thus detailed descriptions thereof will be omitted.

The coupling window 530 may include a first window 531, a second window 532, and a third window 533. The first window 531, the second window 532, and the third window 533 may have an elongated structure in one direction. The first window 531, the second window 532, and the third window 533 may have the same width and width, but are not limited thereto and may have various widths and widths. The total window length of the coupling window 530 may be equal to or greater than half a working wavelength of the waveguide filter 500. The coupling window 530 that satisfies these conditions may generate negative coupling.

One end of the first window 531 and one end of the second window 532 may be connected to each other. The other end of the second window 532, i.e., an end that is not connected to the first window 531, may be connected to one end of the third window 533. For example, the first window 531 and the third window 533 may be perpendicular to both flat plate surfaces, and the second window 532 may be perpendicular to the first window 531 and the third window 533. The coupling window 530 satisfying these conditions may be U-shaped.

Figure 8:
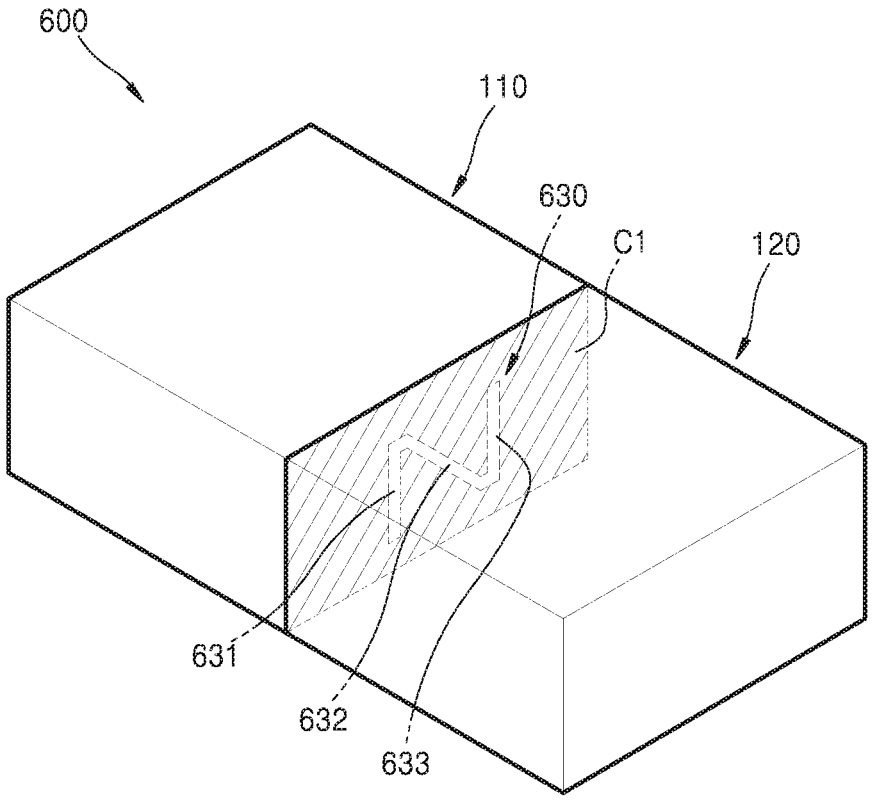
FIG. 8 is a perspective view schematically showing a structure of a waveguide filter according to another embodiment.

FIG. 8 is a perspective view schematically showing a structure of a waveguide filter 600 according to another embodiment. Referring to FIG. 8, the waveguide filter 600 may include an N-shaped coupling window 630. Other components of the waveguide filter 600 are the same as those of the waveguide filter 100, and thus detailed descriptions thereof will be omitted.

The coupling window 630 may include a first window 631, a second window 632, and a third window 633. The first window 631, the second window 632, and the third window 633 may have an elongated structure in one direction. The first window 631, the second window 632, and the third window 633 may have the same width and width, but are not limited thereto and may have various widths and widths. The total window length of the coupling window 630 may be equal to or greater than half a working wavelength of the waveguide filter 600. The coupling window 630 that satisfies these conditions may generate negative coupling.

One end of the first window 631 and one end of the second window 632 may be connected to each other. The other end of the second window 632, that is, an end which is not connected to the first window 631, may be connected to one end of the third window 633. For example, the first window 631 and the third window 633 may be parallel to each other, and the second window 632 may not be perpendicular to the first window 631 and the third window 633. For example, the second window 632 may have a predetermined angle with the first window 631. For example, the second window 632 may be provided at 15 degrees, 30 degrees, 45 degrees, and 60 degrees with the first window 631. The coupling window 630 satisfying these conditions may be N-shaped.

Figure 9:
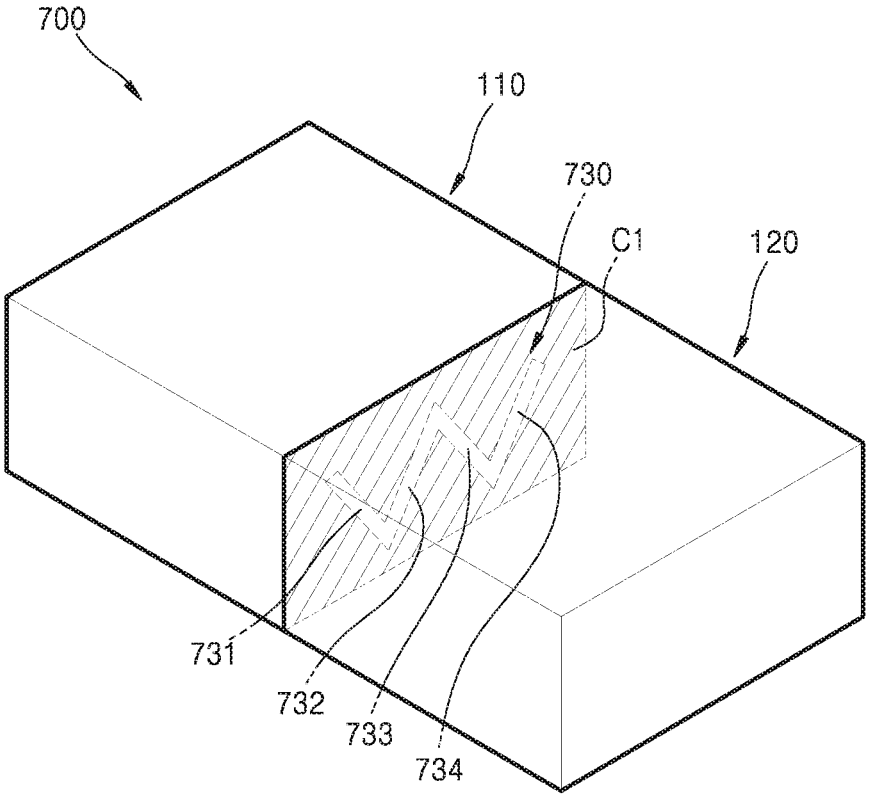
FIG. 9 is a perspective view schematically showing a structure of a waveguide filter according to another embodiment.

FIG. 9 is a perspective view schematically showing a structure of a waveguide filter 700 according to another embodiment. Referring to FIG. 9, the waveguide filter 700 may include a W-shaped coupling window 730. Other components of the waveguide filter 700 are the same as those of the waveguide filter 100, and thus detailed descriptions thereof will be omitted.

The coupling window 730 may include a first window 731, a second window 732, a third window 733, and a fourth window 734. The first window 731, the second window 732, the third window 733, and the fourth window 734 may have an elongated structure in one direction. The first window 731, the second window 732, the third window 733 and the fourth window 734 may have the same width and width but may have various widths and widths. The total window length of the coupling window 730 may be equal to or greater than half a working wavelength of the waveguide filter 700. The coupling window 730 that satisfies these conditions may generate negative coupling.

The first window 731, the second window 732, the third window 733, and the fourth window 734 may be sequentially connected. For example, one end of the first window 731 and one end of the second window 732 may be connected to each other. For example, the other end of the second window 732, i.e., an end not connected to the first window 731, may be connected to one end of the third window 733. For example, the other end of the third window 733 may be connected to one end of the fourth window 734.

For example, the first window 731 and the third window 733 may be parallel to each other, and the second window 732 and the fourth window 734 may be parallel to each other. For example, the first window 731 and the second window 732 may have a predetermined angle with respect to each other. For example, the first window 731 and the second window 732 may have angles of 15 degrees, 30 degrees, 45 degrees, 60 degrees, etc. The coupling window 730 satisfying these conditions may be W-shaped.

Figure 10:
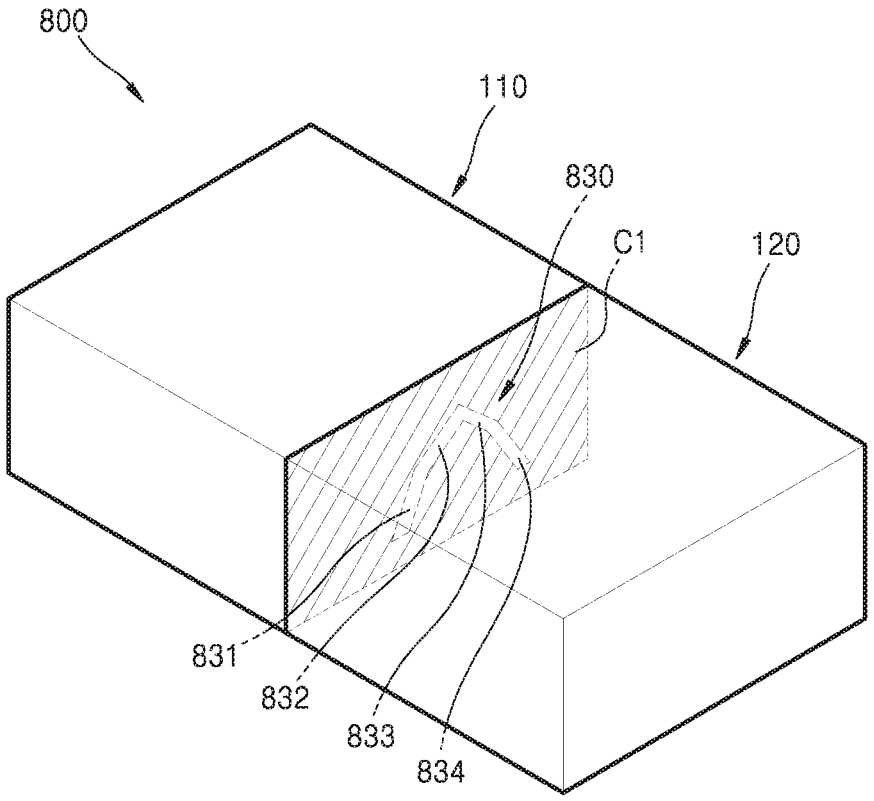
FIG. 10 is a perspective view schematically showing a structure of a waveguide filter according to another embodiment.
Figure 11:
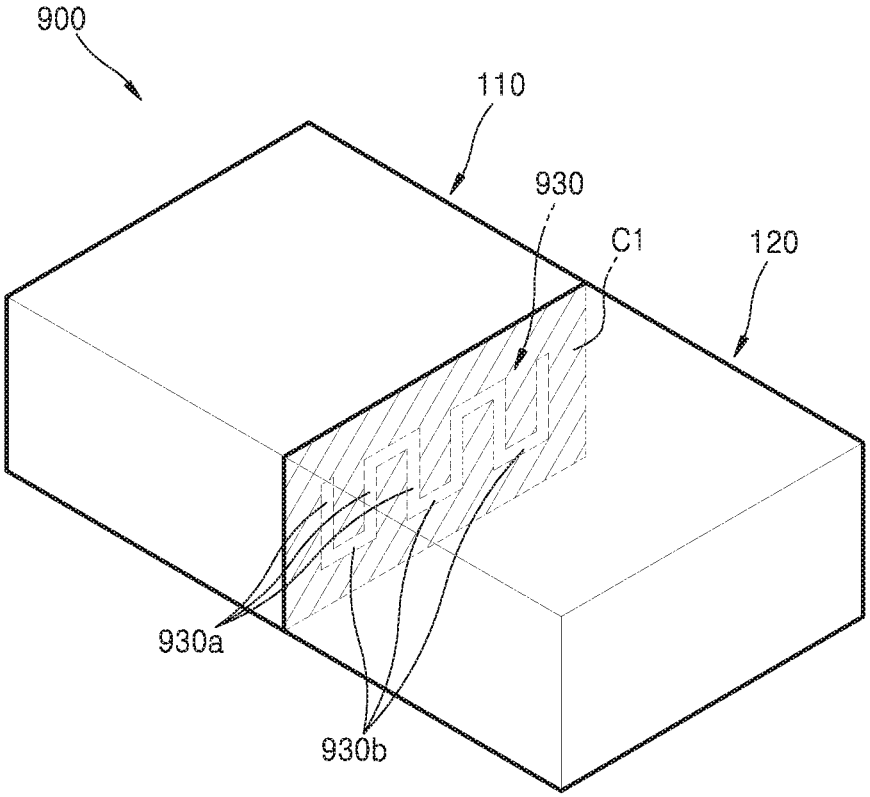
FIG. 11 is a perspective view schematically showing a structure of a waveguide filter according to another embodiment.

FIG. 10 is a perspective view schematically showing a structure of a waveguide filter 800 according to another embodiment. Referring to FIG. 11, the waveguide filter 800 may include an arch-shaped coupling window 830. Other components of the waveguide filter 800 are the same as those of the waveguide filter 100, and thus detailed descriptions thereof will be omitted.

The coupling window 830 may include a first window 831, a second window 832, a third window 833, and a fourth window 834. The first window 831, the second window 832, the third window 833, and the fourth window 834 may have an elongated structure in one direction. The first window 831, the second window 832, the third window 833 and the fourth window 834 may have the same width and width but may have various widths and widths. The total window length of the coupling window 830 may be equal to or greater than half a working wavelength of the waveguide filter 800. The coupling window 830 that satisfies these conditions may generate negative coupling.

The first window 831, the second window 832, the third window 833, and the fourth window 834 may be sequentially connected. For example, one end of the first window 831 and one end of the second window 832 may be connected to each other. For example, the other end of the second window 832, i.e., an end that is not connected to the first window 831, may be connected to one end of the third window 833. For example, the other end of the third window 833 may be connected to one end of the fourth window 834.

For example, the coupling window 830 may include the first window 831, the second window 832, the third window 833, and the fourth window 834 that may be sequentially connected such that the second window 832 and the third window 833 may be symmetrical with respect to a contact point of the second window 832 and the third window 833. For example, the first window 831 and the second window 832 may be provided to form an obtuse angle with each other, the second window 832 and the third window 833 may be provided to form an obtuse angle with each other, and the third window 833 and the fourth window 834 may be provided to form an obtuse angle with respect to each other. For example, a line connecting one end of the first window 831 (an end not connected to the second window 832) and one end of the fourth window 834 (an end not connected to the third window 833) may be parallel to both flat plate surfaces of a resonator. The coupling window 830 satisfying these conditions may be arch-shaped.

Figure 12:
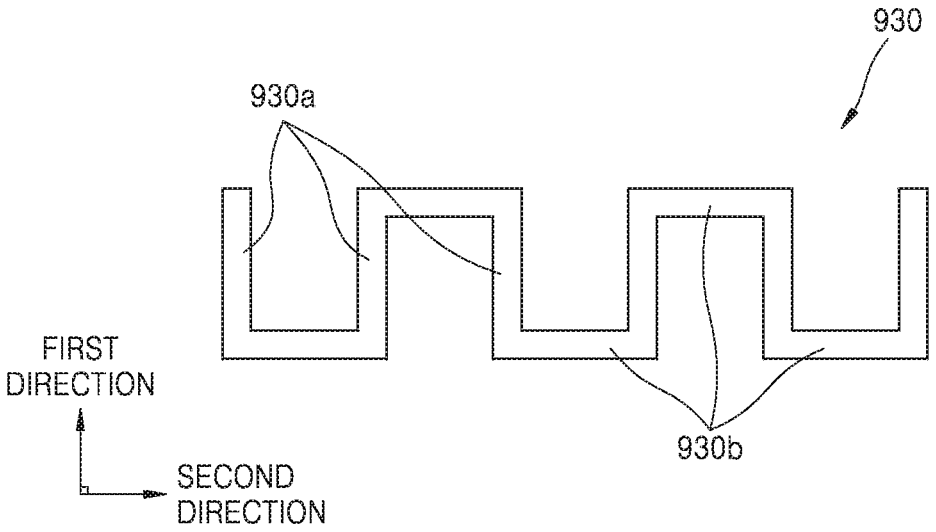
FIG. 12 is a view schematically showing a structure of a negative coupling window included in the waveguide filter according to FIG. 11.
Figure 13:
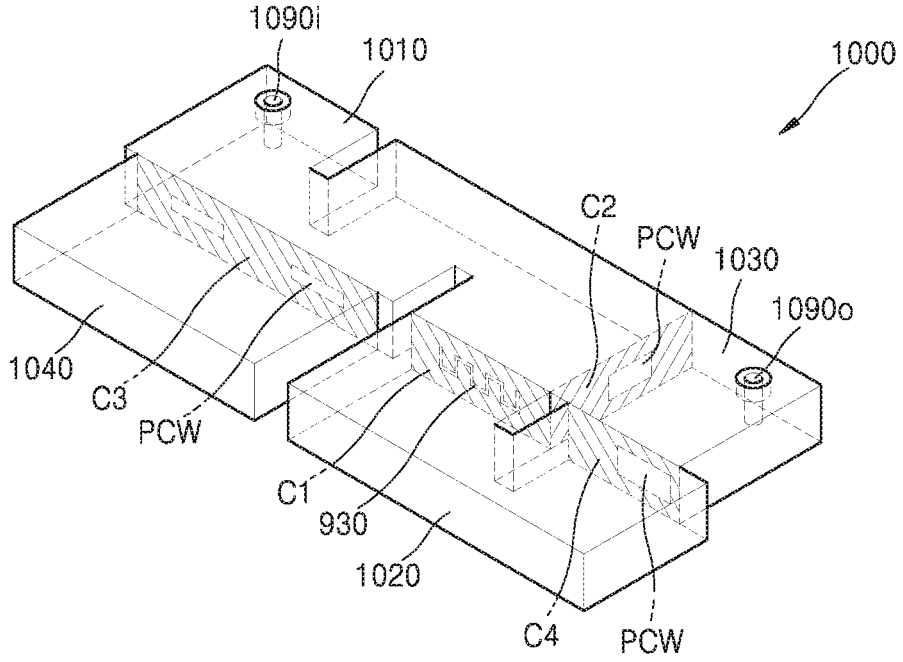
FIG. 13 is a perspective view schematically showing a structure of a waveguide filter according to another embodiment.

FIG. 11 is a perspective view schematically showing a structure of a waveguide filter 900 according to another embodiment. FIG. 12 is a view schematically showing a structure of a negative coupling window 930 included in the waveguide filter 900 according to FIG. 11. Referring to FIGS. 12 and 13, the waveguide filter 900 may include a coupling window 930 in a winding shape. Other components of the waveguide filter 900 are the same as those of the waveguide filter 100, and thus detailed descriptions thereof will be omitted.

The coupling window 930 may include a plurality of first window members 930*a* and a plurality of second window members 930*b*. The plurality of first window members 930*a* and the plurality of second windows 930*b* may be respectively connected to each other such that the coupling window 930 may have a single elongated window shape. For example, the coupling window 930 may have the winding shape.

The plurality of first window members 930*a* may have an elongated shape in a first direction. The plurality of first window members 930*a* may be arranged parallel to each other along a second direction perpendicular to the first direction. The plurality of first window members 930*a* may be spaced apart from each other, but are not limited thereto. The plurality of first window members 930*a* may have the same width and width but are not limited thereto. For example, the first direction may be perpendicular to both flat planar surfaces of the resonators 110 and 120, but is not limited thereto.

The plurality of second window members 930*b* may have an elongated shape in the second direction. The plurality of second window members 930*b* may be arranged to be parallel to the second direction. The plurality of second window members 930*b* may have the same width and width but are not limited thereto.

Each of the plurality of second window members 930*b* may not be in contact with each other. Each of the plurality of second window members 930*b* may be combined with ends of the most adjacent two first window members 930*a*. For example, the plurality of first window members 930*a* and the plurality of second window members 930*b* may extend by sequentially connecting both ends thereof. The coupling window 930 satisfying these conditions may have a winding shape.

According to an experiment, when lengths of the plurality of second window members 930*b* are maintained, in the case that a length of the first window member 930*a* is relatively short compared to a length of the second window member 930*b*, the coupling window 930 may generate strong negative coupling.

Figure 14:
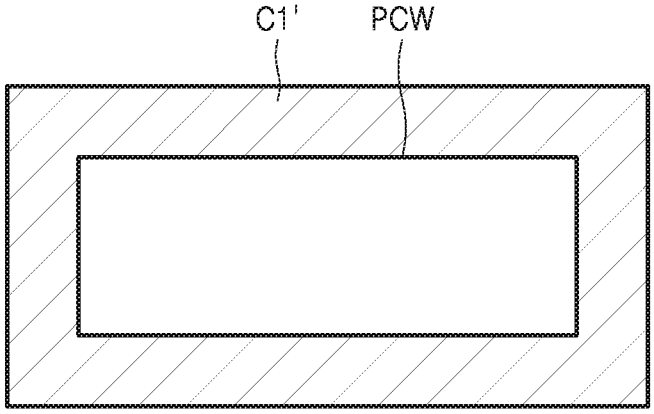
FIG. 14 is a cross-sectional view schematically showing structures of positive coupling windows included in the waveguide filter according to FIG. 13.

FIG. 13 is a perspective view schematically showing a structure of a waveguide filter 1000 according to another embodiment. FIG. 14 is a cross-sectional view schematically showing structures of positive coupling windows PCW included in the waveguide filter 1000 according to FIG. 13.

Referring to FIG. 13, the waveguide filter 1000 may include a first resonator 1010, a second resonator 1020, a third resonator 1030, and a fourth resonator 1040.

The coupling window (950 in FIG. 12) may be located in a region of the contact surface CI between the first resonator 1010 and the second resonator 1020. The total window length of the coupling window (950 in FIG. 12) may be equal to or greater than half a working wavelength of the waveguide filter 1000. The coupling window (950 in FIG. 12) may generate negative coupling between the first resonator 1010 and the second resonator 1020. A shape of the coupling window (950 in FIG. 12) is not limited to that shown in FIG. 14, and may have various shapes according to the above-described embodiment.

The positive coupling window PCW may be provided on a contact surface C2 between the first resonator 1010 and the third resonator 1030. The two positive coupling windows PCW may be provided on a contact surface C3 between the first resonator 1010 and the fourth resonator 1040. The positive coupling window PCW may be provided on a contact surface C4 between the second resonator 1020 and the third resonator 1030. Positive coupling between resonators in contact with each other through the positive coupling windows PCW may be generated. Each of the positive coupling windows PCW may have an area larger than a sum of the total area of a plurality of windows of the coupling window (950 of FIG. 12).

Referring to FIG. 14, the positive coupling window PCW may be located on a region of a contact surface CI'. For example, the positive coupling window PCW may have a rectangular shape. The positive coupling window PCW is not limited to a rectangular shape, and may have various shapes according to practical requirements. The positive coupling window PCW may allow positive coupling to occur between adjacent resonators (not shown).

The second resonator 1020 and the fourth resonator 1040 may not be in direct contact with each other, but are not limited thereto. Various types of resonators may be combined in various ways according to the purpose of use of the waveguide filter 1000. In case of generating negative coupling, the coupling window according to the above-described embodiment may be applied.

The waveguide filter 1000 according to the present disclosure may freely determine a length and width of the positive coupling window PCW, but may not affect the coupling window (950 in FIG. 12) that generates negative coupling. In other words, a coupling window between resonators which are to generate negative coupling irrespective of a combination of another coupling window and a shape thereof may generate negative coupling by only satisfying the above-mentioned Equation 1. Therefore, the waveguide filter 1000 according to the present disclosure can freely determine a coupling relationship between the resonators and may be easily designed.

The first resonator 1010, the second resonator 1020, the third resonator 1030 and the fourth resonator 1040 may include the substrate block (111 in FIG. 1) and the conductive layer CL covering the substrate block (111 in FIG. 1) like the first resonator (110 in FIG. 1). A detailed description is omitted. In the contact surfaces C1, C2, C3, and C4, parts in chain lines except for the coupling window mean parts covered by the conductive layer (CL in FIG. 1). Coupling in an energy mode between the first resonator 1010, the second resonator 1020, the third resonator 1030, and the fourth resonator 1040 must be performed through the coupling windows (PCW, 950 in FIG. 12) and may not be performed through the parts in chain lines.

An input terminal 1090*i* may be provided in the first resonator 1010. An output terminal 1090*o* may be provided in the second resonator 1020. The input terminal 1090*i* is where RF energy is supplied. The output terminal 1090*o* is where RF energy is output. The input terminal 1090*i* and the output terminal 1090*o* may be respectively provided in two different resonators of the first resonator 1010, the second resonator 1020, the third resonator 1030, and the fourth resonator 1040.

Up to now, to facilitate understanding of the present disclosure, an exemplary embodiment of a waveguide filter including a coupling window for negative coupling has been described and illustrated in the accompanying drawings. It should be understood, however, that such embodiments are merely illustrative of the present disclosure and not limiting thereof. It should be understood that the invention is not limited to the details shown and described. This is because various other variations may occur to those of ordinary skill in the art.

The invention claimed is:

1. A waveguide filter comprising:

a plurality of resonators comprising a substrate block and a conductive layer covering a surface of the substrate block; and a coupling window provided on a contact surface between the plurality of resonators, the coupling window exposing the substrate block for coupling of the plurality of resonators, wherein a total window length of the coupling window is equal to or greater than half a working wavelength of the waveguide filter, wherein the coupling window comprises a plurality of windows, and wherein the plurality of windows are connected to each other on the contact surface between the plurality of resonators.

2. The waveguide filter of claim 1, wherein the plurality of windows have shapes elongated in one direction.

3. The waveguide filter of claim 1, wherein the plurality of resonators comprise a first resonator and a second resonator, and wherein the coupling window is located between the first resonator and the second resonator.

4. The waveguide filter of claim 3, wherein the plurality of windows comprise a first window elongated in a first direction and a second window elongated in a second direction, and wherein one end of the first window and one end of the second window are connected to each other.

5. The waveguide filter of claim 4, wherein the plurality of windows further comprise a third window elongated in a third direction that is connected to another end of the second window, and wherein the first direction and the third direction are parallel to each other.

6. The waveguide filter of claim 5, wherein an acute angle formed between the first window and the second window is between 0 and 90 degrees.

7. The waveguide filter of claim 4, wherein the plurality of windows further comprise a third window elongated in one direction and a fourth window elongated in one direction, and wherein one end of the third window is connected to another end of the second window, and an end of the fourth window is connected to another end of the third window.

8. The waveguide filter of claim 7, wherein the first window and the third window are parallel to each other, and wherein the second window and the fourth window are parallel to each other.

9. The waveguide filter of claim 3, wherein the plurality of windows comprise a first window elongated in a first direction and a second window elongated in a second direction, and wherein one end of the first window and a central portion of the second window are connected to each other.

10. The waveguide filter of claim 3, wherein the plurality of windows comprise a plurality of first window members each having an elongated shape in a first direction and parallel to each other along a second direction perpendicular to the first direction, and a plurality of second window members each having the elongated shape in the second direction and parallel to the second direction, and wherein the plurality of second window members are not in contact with each other, and each of the plurality of second members is combined with one end of two adjacent first window members.

11. The waveguide filter of claim 1, wherein the substrate block is formed of a dielectric material.

12. The waveguide filter of claim 1, wherein the conductive layer is formed of silver.

13. The waveguide filter of claim 1, wherein the plurality of resonators further comprise at least one independent adjustable member.

14. The waveguide filter of claim 1, further comprising:

an input terminal; and an output terminal, wherein the input terminal and the output terminal are located in different ones of the plurality of resonators.

15. The waveguide filter of claim 1, wherein the coupling window has any one of a V shape, a T shape, a U shape, a W shape, an N shape, a twisted shape, and an arch shape.

* * * * *